United States Patent [19]

Spinner

[11] Patent Number: 4,884,046

[45] Date of Patent: Nov. 28, 1989

[54] TRANSMITTER/ANTENNA BAY

[76] Inventor: Georg Spinner, Am Eichberg 12, 8152 Feldkirchen-Westerham, Fed. Rep. of Germany

[21] Appl. No.: 231,188

[22] Filed: Aug. 11, 1988

[30] Foreign Application Priority Data

Aug. 14, 1987 [DE] Fed. Rep. of Germany ..... 3727200

[51] Int. Cl.[4] ..... H01P 1/04

[52] U.S. Cl. ..... 333/260; 333/255; 403/322; 403/330; 439/157

[58] Field of Search ..... 333/255, 260; 439/152, 439/153, 157, 578; 24/134 R, 134 KB, 136 K; 285/311, 312, 320; 403/322, 330, DIG. 4

[56] References Cited

U.S. PATENT DOCUMENTS

| | | | |
|---|---|---|---|
| 1,793,015 | 2/1931 | Roos | 285/311 |
| 3,083,274 | 3/1963 | Sparkes | 439/153 X |
| 3,625,548 | 12/1971 | Boehm | 285/311 X |
| 4,768,006 | 8/1988 | Trift et al. | 333/255 |

FOREIGN PATENT DOCUMENTS

| | | | |
|---|---|---|---|
| 504972 | 12/1952 | Belgium | 285/311 |
| 686999 | 2/1953 | United Kingdom | 285/311 |

*Primary Examiner*—Paul Gensler
*Attorney, Agent, or Firm*—Henry M. Feiereisen

[57] ABSTRACT

A transmitter/antenna bay for selectively connecting at least two coaxial lines of a plurality of coaxial lines via flange sockets incorporated in the front panel of the transmitter/antenna bay includes a locking apparatus for latching the housing of a pluggable coaxial transmission line or coaxial switch with the front panel. The locking apparatus includes lever locks arranged at the narrow sides of the housing at a level of the flange socket. Each lever lock comprises an approximate L-shaped hook with a short leg grasping behind a continuous collar of the flange socket in locking position of the hook and with a long leg which is swingably mounted and guided for longitudinal displacement. The long leg of the hook is articulated to one arm of a two-armed locking lever which is pivoted to a support. Defined between the point of articulation of the hook to the locking lever and the collar in the area which is engaged by the short leg is a line of action which extends on one side of the pivot pin in locking position and on the other side of said pivot pin in disengaged position so as to attain a self-locking mechanism.

15 Claims, 4 Drawing Sheets

TRANSMITTER/ANTENNA BAY

BACKGROUND OF THE INVENTION

The present invention refers to a transmitter/antenna bay, and in particular to an apparatus for locking the housing of a coaxial transmission line connection or a coaxial switch with the front panel of a transmitter/antenna bay.

A transmitter/antenna bay is provided for selectively connecting at least two coaxial lines of a plurality of coaxial lines and includes a front panel accommodating flange sockets to which the coaxial lines are attached. The coaxial lines can be linked to each other by pluggable transmission line connections or coaxial switches. In general, the locking devices incorporated in a transmitter/antenna bay of this kind regardless whether it is a plug bay or switch bay are usually of very complicated structure and design in order to ensure a secure contact making and to prevent an unintentional withdrawal of the transmission line connection or coaxial switch.

SUMMARY OF THE INVENTION

It is thus an object of the present invention to provide an improved transmitter/antenna bay obviating the afore-stated drawbacks.

This object and others which will become apparent hereinafter are attained in accordance with the present invention by providing a locking apparatus which includes a locking lever swingably mounted about a pivot pin fixed to the housing at a distance thereto, and a hook hinged to the locking lever at a point of articulation and suitably supported to allow a swinging motion and a longitudinal displacement for moving between a locking position in which the hook engages a collar of the flange socket and a disengaged position in which the hook is removed from the collar wherein the point of articulation defines with the collar a line of action which extends on one side of the pivot pin in locking position and on the other side of the pivot pin in disengaged position.

Through the provision of a locking apparatus according to the invention, a close connection is attained with the coaxial transmission line connection or the coaxial switch, with the locking apparatus being advantageously designed essentially as a separate unit which ensures a secure contact making over a given path. Moreover, the front panel of the transmitter/antenna bay does not require any openings for the locking apparatus, and the position of the locking lever allows an operator to easily determine whether or not the respective connection between transmitter and antenna is made.

Suitably, the hook is of approximate L-shape and includes a short leg which cooperates with the collar of the flange socket and is preferably made of elastic material to give the hook a certain longitudinal elasticity, and a bifurcated long leg whose prongs are connected by a transverse bolt which traverses an inclined slot in a support structure fixed to the housing and carrying the pivot pin of the locking lever. In this manner, the hook can be designed as one-piece unit.

According to a modification of the present invention, the long leg of the hook may be accommodated in a hollow support and may respectively end in a transverse pin guided in slots of the support and connected outside the latter to the point of articulation of the locking lever via bars. Thus, the hook is essentially hidden and allows a particular accurate setting of the combined swinging motion and shifting motion thereof. Preferably, the long leg includes a bend inwardly extending relative to the short leg and guided by internal and external guide surfaces.

According to a further modification of the present invention, the L-shaped hook is not supported by an additional pivot but is only articulated to the locking lever. The long leg is angled outwards relative to the short leg and guided between internal and external guide surfaces fixed to the housing.

Preferably, the locking lever may be provided with a ball catch to allow a locking of the hook in the locking position and in the disengaged position in addition to the self-locking mechanism which is attained by defining the line of action in the afore-stated manner. The ball catch includes a spring-loaded ball which is movable between two grooves of the support.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1B:
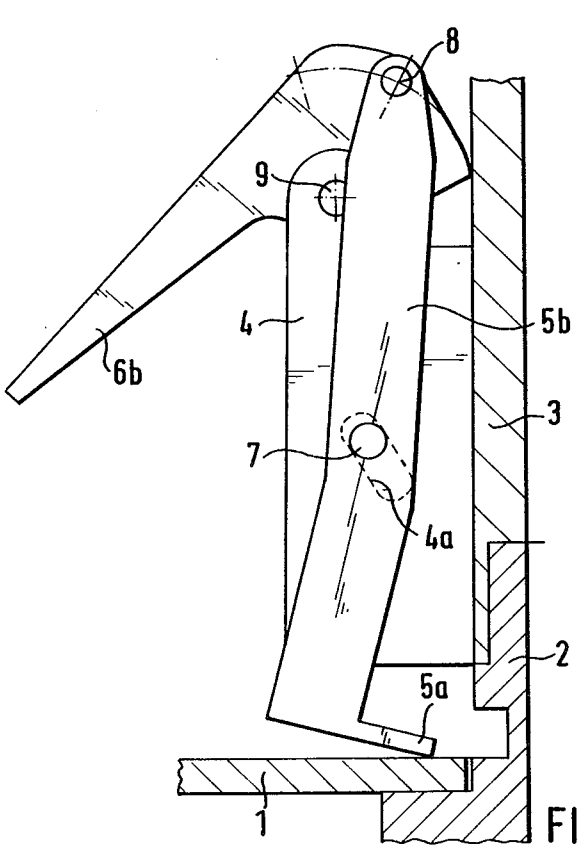
FIG. 1*b* is a partial sectional view of the locking apparatus of FIG. 1*a* in partly disengaged position.

Referring now to the drawing, and in particular to FIGS. 1*a* to 1*d*, there is shown a first embodiment of a locking apparatus in accordance with the present invention, with the locking apparatus incorporated in a transmitter/antenna bay for latching the housing of a coaxial connector or coaxial switch with the front panel of the bay. For ease of illustration, the transmitter/antenna bay is shown only with those parts which are considered relevant for an understanding of the present invention.

The transmitter/antenna bay includes a front panel 1 accommodating a flange socket 2 of which only the outer conductor flange is shown. As further illustrated in FIG. 1*c* by broken lines, the flange socket 2 further includes an inner conductor and an insulator for supporting the inner conductor. In this context, reference is made to applicant's own patent application, Ser. No. 162,109, now Pat. No. 4,847,576, in which an exemplified transmitter/antenna bay is shown and described. Plugged into the socket is coaxial transmission line connection or a coaxial switch of which only a part of a housing wall 3 is shown. Extending at opposing narrow sides of the pluggable coaxial transmission line or coaxial switch are at least two lever locks which are disposed symmetrical to each other so that only one is shown in the view of FIGS. 1*a* to 1*c*.

Each lever lock includes a support structure 4 which is fixedly connected to the housing wall 3 and carries an essentially L-shaped hook which is generally designated by reference numeral 5, and a two-armed locking lever generally designated by reference numeral 6. The L-shaped hook 5 includes a short leg 5*a* at the lower end of the hook 5 and a long leg 5*b* which is slightly angled and bifurcated as shown in FIG. 1*d*. The short leg 5*a* is preferably of elastic material and cooperates with a continuous collar 2*a* of the flange socket 2 in a manner to be described further below.

Figure 1A:
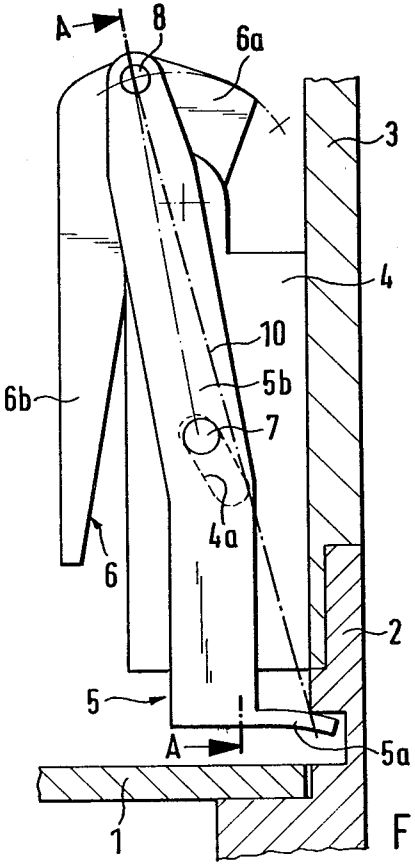
FIG. 1*a* is a partial sectional view of a first embodiment of a locking apparatus in accordance with the present invention, with the locking apparatus being shown in locking position.
Figure 1D:
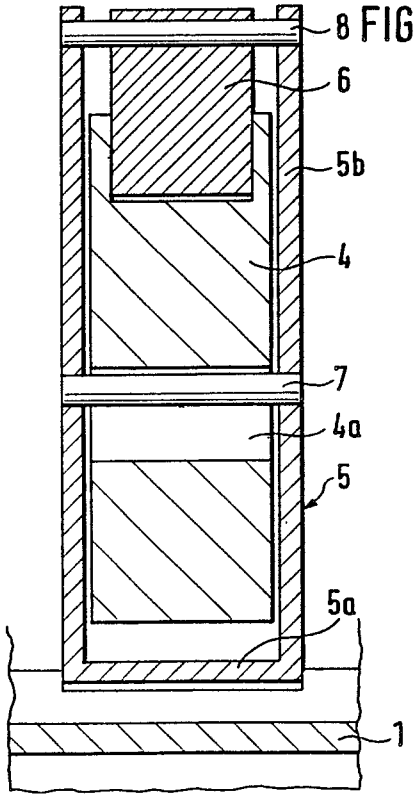
FIG. 1*d* is a cross-sectional view of the locking apparatus taken along the line A—A in FIG. 1*a*.
Figure 1C:
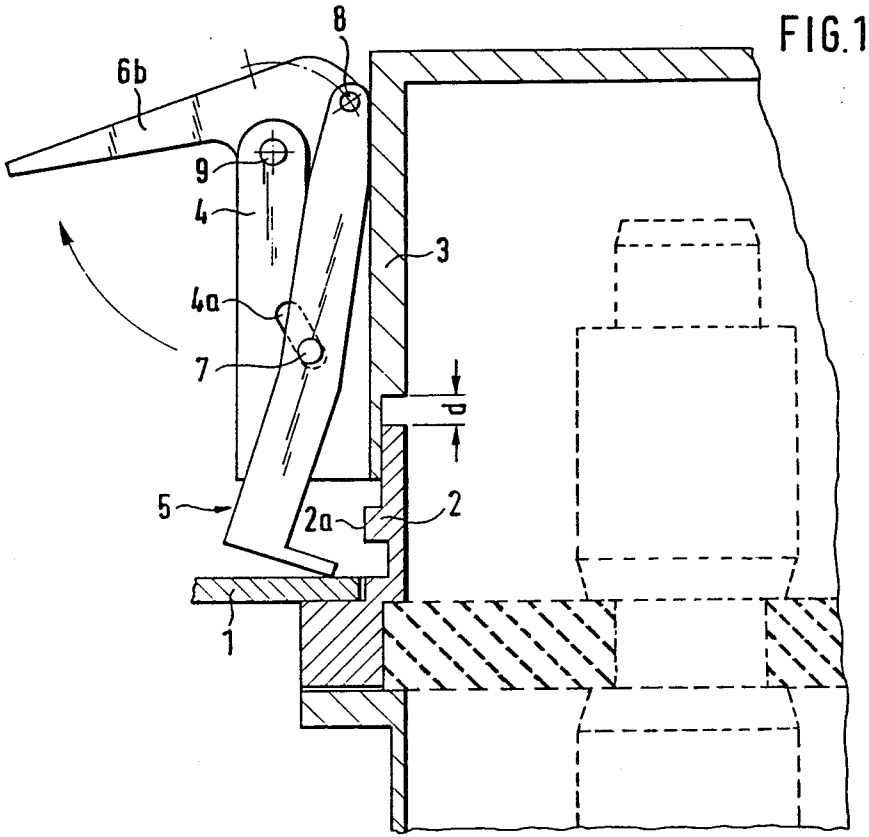
FIG. 1*c* is a partial sectional view of the locking apparatus of FIG. 1*a* in disengaged position.

Both prongs of the long leg 5*b* (only one is shown in FIGS. 1*a* to 1*c*) are connected to each other at about a central location thereof by a transverse bolt 7 which traverses an oblique slot 4*a* of the support structure 4. The longitudinal axis of the slot 4*a* defines with the plane which extends through the housing wall 3, an angle pointing toward the front panel 1 or flange socket 2.

The upper end of the support structure 4 is slotted and includes a pivot pin 9 for rotatably supporting the two-armed locking lever 6. Articulated at 8 to the short arm 6*a* of the locking lever 6 are the upper ends of the long leg 5*a* of the hook 5. The mutual relationship between the point of articulation 8 and the pivot pin 9 is selected in such a manner that the line of action 10 which is indicated by dash-dot line and connects the part of the collar 2*a* embraced by the short leg 5*a* and the point of articulation 8, extends at one side of the pivot pin 9 in the locking position as shown in FIG. 1*a*, and on the other side of the pivot pin 9 in the disengaged position as shown in FIGS. 1*b* and 1*c*. In this manner a self-locking mechanism is attained in the locking position.

FIGS. 1*a* to 1*c* show various stages of the locking apparatus according to the invention. In the disengaged position as depicted in FIG. 1*c*, the long arm 6*b* of the locking lever 6 is directed outwardly and thus indicates to the operator the disengaged position of the locking apparatus. The short leg 5*a* of the lever 5 bears against the front panel 1 and thus pushes the housing 3 away from the front panel 1 thereby defining a distance d between the housing 3 and the flange socket 2. Upon depressing the long arm 6*b* of the locking lever 6, the support structure 4 together with the housing 3 will be forced toward the flange socket 2 until the distance d is zero whereby the transverse bolt 7 moves within the slot 4*a* from one end in direction to the other end thereof (FIG. 1*b*). After overcoming the distance d and further depressing the lever 6, the short leg 5*a* grasps the collar 2*a* from behind and draws the housing 3 and thus the entire transmission line connection against the flange socket 2 (FIG. 1*a*). The respective position of the long arm 6*b* of the locking lever 6 indicates whether the transmission line connection is locked or disengaged.

By means of the slot 4*a*, a translational motion is attained in addition to the swinging motion of the short leg 5*a* of the L-shaped hook 5 whereby the longitudinal axis of the slot 4*a* extends at an angular alignment relative to the vertical so that the translational displacement and the swinging motion are coordinated to ensure that already with beginning locking action, the short leg 5*a* of the hook 5 grasps behind the collar 2*a*, and the housing 3 (and thus the entire transmission line connection) is drawn toward the flange socket 2 until the distance d becomes zero.

When being disengaged, the slot 4*a* forces the short leg 5*a* to bear against the front panel 1 so as to push apart the housing 3 and the flange socket 2 and thus to lift the entire transmission line connection or the coaxial switch. By means of the distance d, it is possible to adjust a not shown contact unit for the carrier safety loop so as to ensure an interruption of the loop in the disengaged state.

Figure 2C:
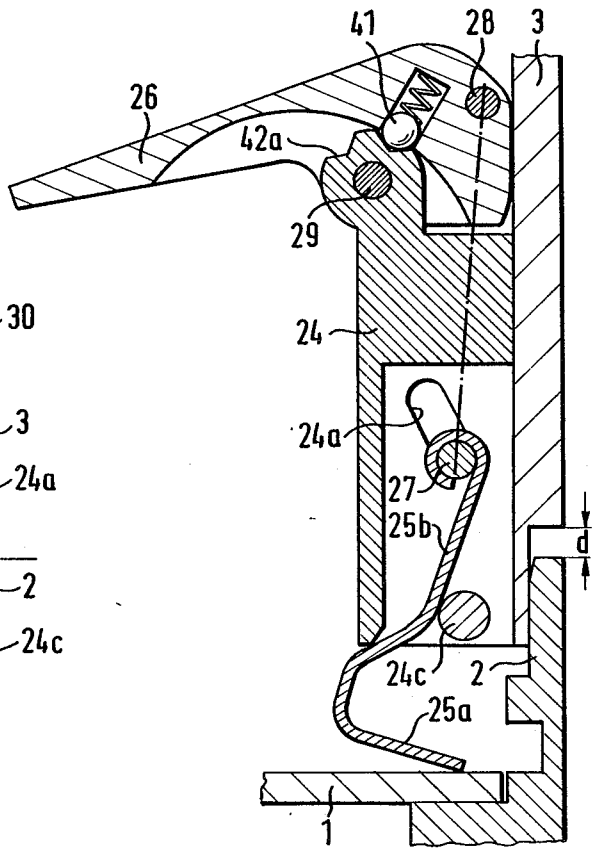
FIG. 2*c* is a sectional view of the locking apparatus of FIG. 2*a* in disengaged position.
Figure 2B:
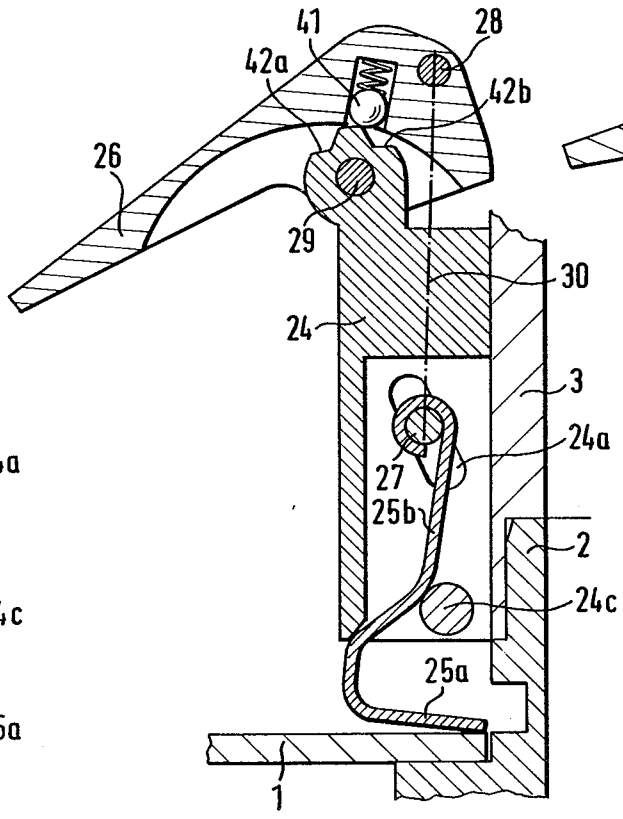
FIG. 2*b* is a sectional view of the locking apparatus of FIG. 2*a* in partly disengaged position.
Figure 2A:
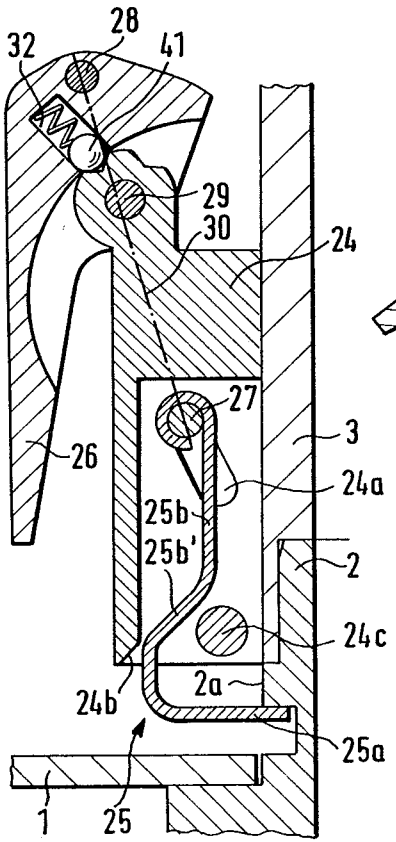
FIG. 2*a* is a sectional view of a second embodiment of a locking apparatus in accordance with the present invention, with the locking apparatus being shown in locking position.

Turning now to FIGS. 2 to 2*c*, there is shown a second embodiment of a locking apparatus in accordance with the present invention, with same reference numerals being used for identical parts as shown in FIGS. 1*a* to 1*c*. Each lever lock includes a hollow support member 24 which accommodates a major part of an L-shaped hook 25. The hook 25 is defined by a long leg 25*b* with a bend 25*b* at the junction to the short leg 25*a* and is connected at its end opposite to the bend 25*b* to a transverse bolt 27 which is guided in two inclined slots 24*a* of the support member 24. The slots 24*a* extend symmetrical to each other so that only one slot 24*a* is depicted in FIGS. 2*a* to 2*c*.

The transverse bolt 27 projects with its ends beyond the support member 24 and is connected at each end thereof to a bar or the like as indicated symbolically by dash-dot line 30. The bars 30 are articulated at 28 to a two-armed locking lever 26 which is swingably mounted on a pivot pin 29 of the upper slotted part of the support member 24. In the embodiment of FIGS. 2*a* to 2*c*, the location of the point of articulation 28 and the pivot pin 29 are again selected in such a manner that a self-locking mechanism is attained in the locking position. As shown in FIGS. 2*a* to 2*c*, the bars 30 extend in a same manner as the line of action 10 as indicated in FIGS. 1*a* to 1*c* basically at one side of the pivot pin 29 in the locking position while extending at the other side thereof in the disengaged position to provide this self-locking mechanism.

In addition to this self-locking mechanism, the locking apparatus is further provided with a ball catch between the support member 24 and the locking lever 26. The ball catch is provided by a recess 32 arranged in the locking lever 26 and accommodating a spring-loaded ball 41 which runs along a guideway with two index grooves 42*a*, 42*b* of the support member 24.

In order to guide the hook 25 during locking and disengagement, the support member 24 is provided at a suitable location with a transverse pin 24*c* at one side of the hook 25 while the lower edge of the support member 24 at the other side of the hook 25 is slanted to define a suitable guide surface 24*b*.

In the disengaged position as shown in FIG. 2*c*, the long leg 25*b* of the hook 25 bears against the guide surface 24*b* and the transverse pin 24*c* and forces the front panel 1 apart from the housing 3 so that the distance d is defined therebetween. This position of the locking apparatus is indicated by the outwardly projecting lever 26. The ball 41 sits in the groove 42*b*, and the bar 30 extends at one side of the pivot pin adjacent to the housing wall 3 so that the disengaged position is securely maintained.

When depressing the lever 26, the housing 3 is forced downwards toward the front panel 1 until the distance d is zero, with the transverse bolt 27 moving in the slots 24*a* (FIG. 2*b*). The ball 41 is forced out of the groove 42*b* and is moved along the guideway. After further depressing the lever 26, the short leg 25*a* of the hook 25 is lifted off the front panel 1 and grasps the collar 2*a* from behind so as to tightly lock the housing 3 with the front panel 1. The hook 25 is disengaged from the guide surface 24*b* and the transverse pin 24*c* while the ball 41 now rests in the other groove 42*a* (FIG. 2*a*) and the bar 30 extends essentially at the other side of the pivot pin 29. The locking position is again indicated by the lever 26.

Although, only the second embodiment has been equipped with a ball catch, it will be appreciated that certainly the first embodiment, too, as shown in FIGS. 1*a* to 1*c* may also be provided with a similar ball catch. Both embodiments may be constructively dimensioned such that the locking apparatus affords considerable plug forces and withdrawal forces required for large conductor diameters.

Figure 3C:
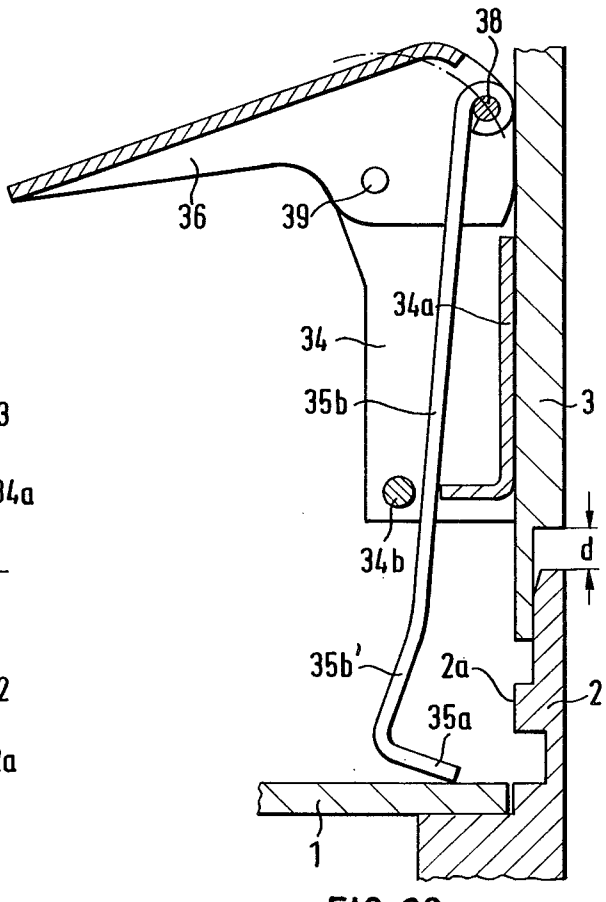
FIG. 3*c* is a partial sectional view of the locking apparatus of FIG. 3*a* in disengaged position.
Figure 3B:
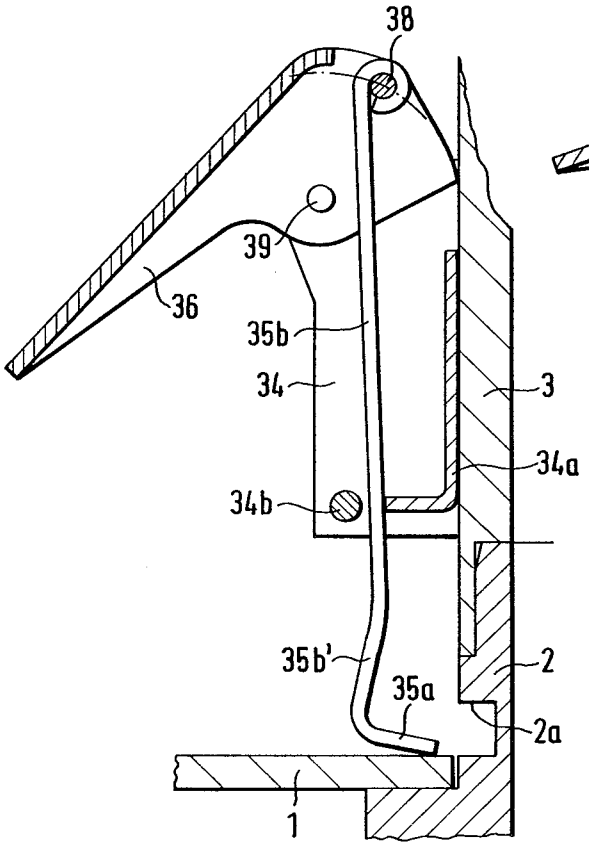
FIG. 3*b* is a partial sectional view of the locking apparatus of FIG. 3*a* in partly disengaged position.
Figure 3A:
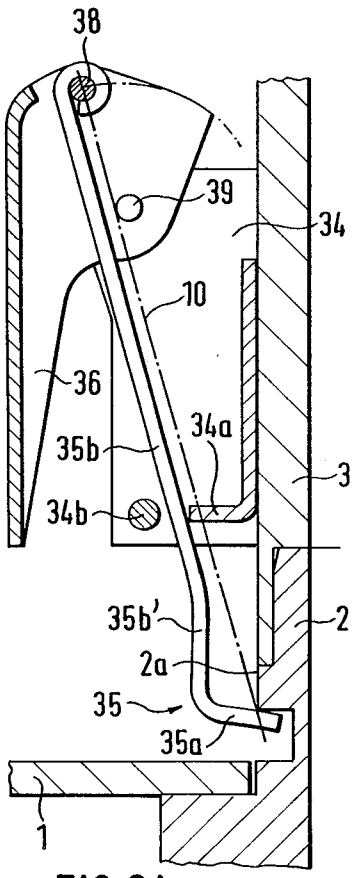
FIG. 3*a* is a partial sectional view of a third embodiment of a locking apparatus in accordance with the present invention, with the locking apparatus being shown in locking position.

Turning now to FIGS. 3*a* to 3*c*, there is shown a third embodiment of a locking apparatus according to the present invention which differs from the previous embodiments in the design of the L-shaped hook. In the third embodiment, a L-shaped hook 35 is provided which has a long leg 35*b* articulated at 38 to the two-armed lever 36 and being without any other intermediate support. The lever 36 is swingably mounted on pivot pin 39 (only schematically indicated) which is of hollow sectional design, and the line of action 10 connecting the point of articulation 38 and the collar 2*a* at the point where it is grasped by the short leg 35*a* extends in a same manner as described with regard to FIGS. 1*a* to 1*c* i.e. on one side of the pivot pin 39 in the locking position and on the other side of the pivot pin 39 in the disengaged position.

The combined swinging motion and translational displacement of the short leg 35*a* of the hook 35 is attained in this embodiment by angling the long leg 35*b* at 35*b* slightly outwardly relative to the short leg 35*a* and guiding the long leg 35*b* by means of guiding surfaces defined internally by an end face of an angle 34*a* attached to the housing wall 3 and a transverse pin 34*b* projecting from the support structure 34. It will be appreciated that guiding surfaces other than those described may be suitable e.g. angled plates or jogs of the hollow support member 34.

The mode of operation of the third embodiment is the same as described in connection with the previously described embodiments. The hook 35 bears with its short leg 35*a* against the front panel for pushing the housing 3 apart from the flange socket 2 thereby defining the distance d (FIG. 3*c*). Upon depressing the lever 36, the hook 35 describes a swinging motion and a translational displacement so that the short leg 35 forces the collar 2*a* of the flange socket 2 against the housing 3 (FIG. 3*a*).

While the invention has been illustrated and described as embodied in a Transmitter/Antenna Bay, it is not intended to be limited to the details shown since various modifications and structural changes may be made without departing in any way from the spirit of the present invention.

What is claimed as new and desired to be protected by Letters Patent is set forth in the appended claims:

1. Apparatus for locking the housing of a coaxial transmission line with the front panel of a transmitter-/antenna bay for selectively connecting at least two coaxial lines of a plurality of coaxial lines via flange sockets incorporated in the front panel, said locking apparatus, comprising: locking means including a locking lever swingably mounted about a pivot pin fixed to the housing at a distance thereto and a hook hinged to said locking lever at a point of articulation, said hook being suitably supported to allow a swinging motion and a longitudinal displacement thereof for movement between a locking position in which said hook engages a collar of the flange socket and a disengaged position in which said hook is removed from the collar, wherein said hook and said locking lever move in opposite direction upon actuation of said locking lever, said point of articulation defining with the collar a line of action which extends on one side of said pivot pin in locking position and on the other side of said pivot pin is disengaged position.

2. Apparatus as defined in claim 1 wherein said hook is swingably mounted about a pivot by which said hook is guided for longitudinal displacement.

3. Apparatus as defined in claim 1, and further comprising a ball catch provided in said locking lever in the area of said pivot pin for arresting said hook in the locking position and in the disengaged position.

4. Apparatus as defined in claim 1 wherein said housing is defined by narrow sides, said locking means being arranged at said narrow sides at a level of the flange socket.

5. Apparatus as defined in claim 4 wherein said locking lever is a two-armed locking lever, said pivot pin being spaced from said narrow sides of said housing.

6. Apparatus as defined in claim 1 wherein said hook is of approximate L-shape and has a short leg which grasps the collar from behind to engage the latter in the locking position and a long leg defining an axis and being of bifurcated shape so as to have two prongs, said long leg being connected to said locking lever at said point of articulation.

7. Apparatus as defined in claim 6 wherein said locking means further includes a support connected to said housing and including said pivot pin of said locking lever, said support having a slot inclined relative to said axis of said long leg for permitting the longitudinal displacement of said hook and being traversed by a transverse bolt which connects said prongs of said bifurcated long leg and about which said hook pivots so as to allow said hook to swing and to be displaced in a longitudinal direction along said slot.

8. Apparatus as defined in claim 6 wherein at least said short leg of said L-shaped hook is made of elastic material.

9. Apparatus as defined in claim 6 wherein said locking means further includes a hollow support connected to said housing and including said pivot pin of said locking lever, said support housing said long leg of said hook and having spaced slots traversed by a transverse bolt which connects said prongs of said bifurcated long leg and about which said hook pivots so as to allow said hook to swing and to be displaced in a longitudinal direction along said slot, said transverse bolt projecting beyond said prongs and being respectively connected outside of said support to bars which connect said long leg to said point of articulation of said locking lever.

10. Apparatus as defined in claim 9 wherein said long leg of said L-shaped hook includes a bend extending inwardly relative to said short leg, and further comprising guiding means for ensuring an accurate longitudinal displacement of said long leg during movement of said hook between said locking position and said disengaged position.

11. Apparatus as defined in claim 10 wherein said guiding means is defined by an internal surface of said housing at one side of said hook and a transverse pin carried by said support and defining a guiding surface at the other side of said hook.

12. Apparatus as defined in claim 6 wherein said long leg includes an angled part extending outwardly relative to said short leg, and further comprising guiding means cooperating with said long leg for providing an accurate guidance of said hook during swinging motion and longitudinal displacement between the locking position and the disengaged position.

13. Apparatus as defined in claim 12 wherein said guiding means includes a guide member attached inside to said housing and defining a guide surface at one side of said hook and a guide member connected to said housing and defining a guide surface at the other side of said hook.

14. A transmitter/antenna bay for selectively connecting at least two coaxial lines of a plurality of coaxial lines, comprising:

a front panel;

flange socket means, including a flange socket attached to each of said coaxial lines and incorporated in said front panel, said flange socket including a collar;

coaxial connecting means including a housing pluggable on said flange sockets for linking the coaxial lines; and locking means for latching said housing of said coaxial connecting means with said front panel, said locking means including a locking lever swingably mounted about a pivot pin fixed to said housing at a distance thereto and an approximate L-shaped hook hinged to said locking lever at a point of articulation, said hook being swingably mounted about a pivot by which said hook is guided for longitudinal displacement so as to be movable between a locking position in which said hook engages said collar and a disengaged position in which said hook is removed from said collar, said point of articulation defining with said collar a line of action which extends on one side of said pivot in in locking position and on the other side of said pivot pin in disengaged position.

15. A transmitter/antenna bay for selectively connecting at least two coaxial lines of a plurality of coaxial lines, comprising:

a front panel;

flange socket means, including a flange socket attached to each of said coaxial lines and incorporated in said front panel, said flange socket including a collar;

coaxial connecting means including a housing pluggable on said flange sockets for linking the coaxial lines;

locking means for latching said housing of said coaxial connecting means with said front panel, said locking means including a locking lever swingably mounted about a pivot pin fixed to said housing at a distance thereto and an approximate L-shaped hook hinged to said locking lever at a point of articulation, said hook being angled outwards away from said housing and suitably supported to allow a swinging motion and a longitudinal displacement thereof for movement between a locking position in which said hook engages said collar and a disengaged position in which said hook is removed from said collar, said point of articulation defining with said collar a line of action which extends on one side of said pivot pin in locking position and on the other side of said pivot pin in disengaged position; and guiding means cooperating with said hook for providing an accurate guidance of said hook during the swinging motion and the longitudinal displacement between said locking position and said disengaged position, said guiding means including a guide member attached inside to said housing and defining a guide surface at one side of said hook and a guide member connected to said housing and defining a guide surface at the other side of said hook.

* * * * *